US005197080A

United States Patent [19]

Johnson et al.

[11] Patent Number: 5,197,080

[45] Date of Patent: Mar. 23, 1993

[54] END CAP FOR COOLING COILS FOR AN ARC FURNACE

[75] Inventors: Eric N. Johnson, Clinton; Roger E. Johnson, Comanche; Craig S. Johnson, Clinton, all of Iowa

[73] Assignee: J. T. Cullen Co., Inc., Fulton, Ill.

[21] Appl. No.: 733,431

[22] Filed: Jul. 22, 1991

[51] Int. Cl.[5] ..... F27D 15/02

[52] U.S. Cl. ..... 373/76; 373/74; 165/172; 285/157; 285/124; 285/901; 138/95

[58] Field of Search ..... 373/76, 74, 113, 158, 373/165; 165/171-173, 175; 285/124-126, 157, 901; 138/95; 432/77; 266/241

[56] References Cited

U.S. PATENT DOCUMENTS

| | | | |
|---|---|---|---|
| 1,712,386 | 5/1929 | Harney | 165/171 |
| 1,767,652 | 6/1930 | Daley | 165/172 |
| 2,258,020 | 10/1941 | Laurent | 285/124 |
| 3,344,811 | 10/1967 | Hoffmann | 285/124 |
| 3,464,402 | 9/1969 | Collura | 165/171 |
| 4,207,060 | 6/1980 | Zangs | 432/77 |

FOREIGN PATENT DOCUMENTS

| | | | |
|---|---|---|---|
| 880884 | 5/1953 | Fed. Rep. of Germany | 285/157 |
| 1146258 | 11/1957 | France | 165/172 |
| 251225 | 10/1947 | Switzerland | 165/172 |
| 490454 | 8/1938 | United Kingdom | 165/172 |
| 1301098 | 12/1972 | United Kingdom | 165/172 |

*Primary Examiner*—Bruce A. Reynolds
*Assistant Examiner*—John A. Jeffery
*Attorney, Agent, or Firm*—Zarley, McKee, Thomte, Voorhees & Sease

[57] ABSTRACT

An end cap is provided for adjacent pipes in the cooling coils of an electric air furnace. Each end cap includes parallel opposite side walls and a curved end portion connecting the side walls. The side walls and end portion define a perimeter edge, the outer portion of which is beveled. The end cap includes a pair of tabs extending from each side wall. The tabs partially fill the crevice between adjacent end pipes so as to provide a stronger weld between the end cap and the pipes. The curvature of the end cap minimizes turbulence of the liquid coolant flowing through the pipes.

20 Claims, 1 Drawing Sheet

END CAP FOR COOLING COILS FOR AN ARC FURNACE

BACKGROUND OF THE INVENTION

Electric arc smelting furnaces are used to remanufacture steels from scrap metals. The scrap metals are heated to a high temperature sufficient to melt the metals to a liquid form. The molten steel then can be processed for further uses.

The melting process imposes much thermal, chemical and mechanical stresses on the furnaces. Consequently, much attention and effort must be given to the structural integrity of the furnaces to assure safe operation and production. Frequent maintenance schedules must be maintained on the furnaces, thereby making recycling of steel very costly. In an attempt to alleviate the stresses, and to lower the operating cost of recycling steels, liquid cooling systems are installed on the furnaces. One such cooling system is disclosed in U.S. Pat. No. 4,207,060, which utilizes a series of cooling pipe coils. Generally, the coils are formed from adjacent pipe sections with a curved end cap welded to the ends of adjacent pipes to form a serpentine path for a liquid coolant flowing through the coils. The coolant is forced through the pipes under pressure to maximize heat transfer.

End caps on the cooling coils typically have two different shapes, curved or rectangular. While rectangular end caps are easier to manufacture, when liquid coolant passes through a rectangular end cap, the corners of the end cap tend to cause turbulent flow, bubbles, and vapor, which reduce thermal conductivity and cause localized overheating. Therefore, greater strength is required for rectangular end caps.

Curved or semi-circular end caps allow for a smoother, more laminate fluid flow. Thus, heat transfer efficiency is increased by maximizing surface contact between the coolant and internal coil surfaces. Also, localized overheating is reduced and strength requirements are decreased.

The junction where the two pipes join the end caps is an important area of concern for efficient and safe operation of an electric arc smelting furnace. At this junction, liquid coolants experience a sharp 180 degree turn and a change in fluid pressure. The change in fluid pressure at the junction can be caused by a slower speed of flow, a drop in flow volume, a greater friction between the liquid and the surface of the end caps, a formation of air bubbles, a formation of vapors, a dead flow area, a collection of mineral deposits due to the irregular shape of the welding compounds, a turbulent flow, and a greater heat accumulation due to a slower rate of thermal conductivity.

Also, since forced fluid flow generates high pipe pressure, the end cap and the parallel pipes must be welded strong enough to withstand the pressure. The only welding surfaces of known end caps are the rims, which makes welding difficult between the cap and the pipe ends, particularly in the valley area between the adjacent pipes.

Therefore, a primary objective of the present invention is the provision of an improved cooling pipe system for electric arc furnaces.

Another objective of the present invention is the provision of improved end caps for coiled cooling pipes of an electric arc furnace.

Still another objective of the present invention is the provision of cooling pipe end caps which improve the structural integrity of the liquid cooling system in electric arc furnaces.

A further objective of this invention is the provision of an end cap for the cooling system of an electric arc furnace which reduces turbulent fluid flow, reduces or eliminates the formation of bubbles and vapors in the coolant, and enhances the thermal conductivity of the furnace liquid cooling system.

SUMMARY OF THE INVENTION

The present invention is directed towards an end cap for the liquid cooling coils of an electric arc furnace. The end cap connects the ends of adjacent pipes so that water or other coolant will flow from one pipe into the next pipe.

The end cap is semicircular in cross section and includes a curved end section with opposite parallel side walls. Extending coplanar from each side wall is a tab or ear which fits within the valley or recess between adjacent pipes. The tab can be bent into the valley between the pipes so as to improve the welding of the end cap to the pipes. The end cap reduces turbulent fluid flow and improves heat transfer efficiency, while increasing the weld strength of the cooling system.

DETAILED DESCRIPTION OF THE PREFERRED EMBODIMENT

Figure 1:
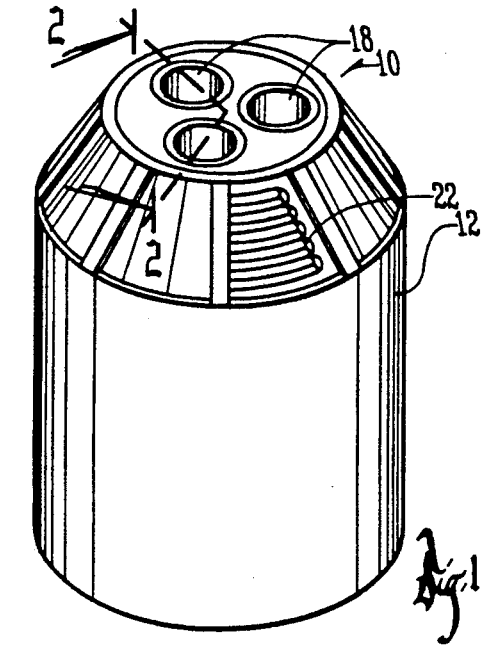
FIG. 1 is a view of an electric arc smelting furnace.
Figure 2:
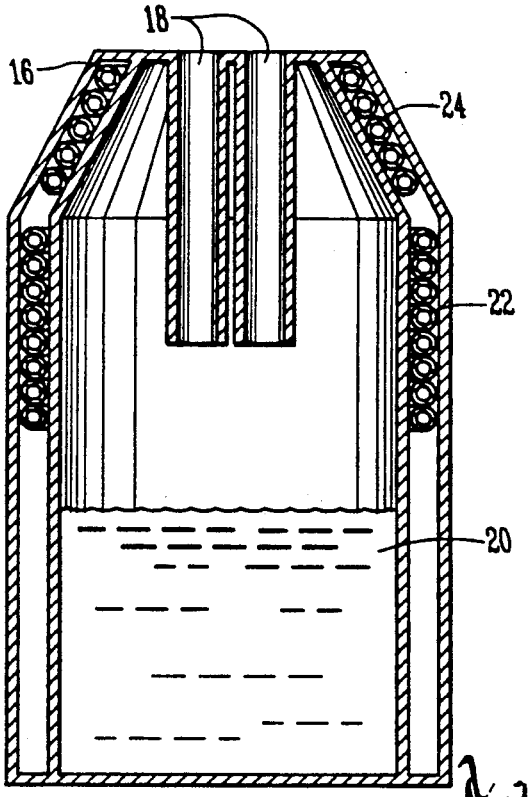
FIG. 2 is a sectional elevation view taken along lines 2—2 of FIG. 1.
Figure 3:
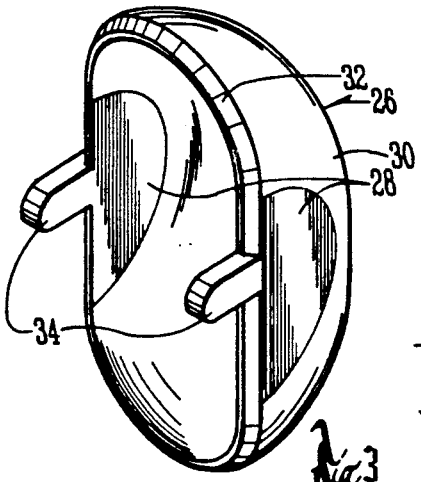
FIG. 3 is a perspective view of the end cap of the present invention.

In the drawings, the reference numeral 10 generally designates an electric arc furnace. The furnace 10 includes a side wall 12, a bottom 14, and a top 16. Top 16 has a truncated conical shape, with openings 18 therein for receiving the electrodes. Furnace 10 is used to melt steel into molten slag 20.

The side walls 12 and top 16 of furnace 10 includes a plurality of cooling coils 22. Coils 22 are formed from a plurality of adjacent pipes 24. The basic construction of furnace 10, including pipes 24 is conventional.

Figure 4:
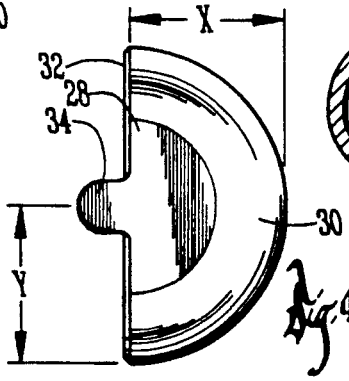
FIG. 4 is side elevational view of the end cap.

The present invention is directed towards an end cap 26 used to connect the ends of adjacent pipes 24. Each end cap 26 is semi-circular in cross section, and includes opposite parallel side walls 28 integrally formed with a curved end portion 30. The curvature of end portion 30 is constant so that the cross sectional area of the end cap taken along any radius is constant. As seen in FIG. 4, the depth X of the end cap is equal to the radius Y from the midpoint of the rim to the upper or lower edge. Radius Y equals the diameter of pipe 24.

End cap 26 has a perimeter edge or a rim 32. The outer portion of rim 32 is beveled, as best seen in FIG. 4, to facilitate welding of the end cap to the pipe.

End cap 26 also includes a pair of ears or tabs 34 extending outwardly from the midpoint of the sides 28.

During the manufacture of end cap 26, tabs 34 are formed coplanar with side walls 28, and are later bent inwardly, as described below.

Figure 6:
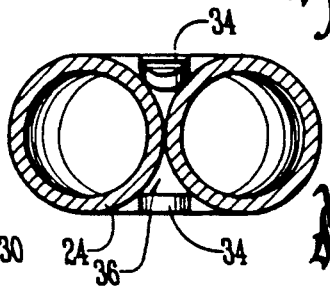
FIG. 6 is a sectional view taken along lines 6—6 of FIG. 5.
Figure 5:
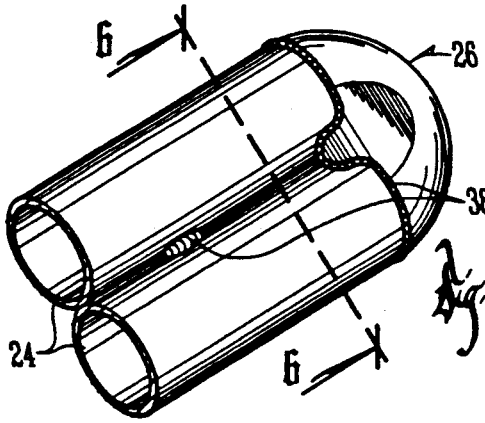
FIG. 5 is a perspective view showing the end caps welded at the ends of two parallel cooling pipes.
Figure 7:
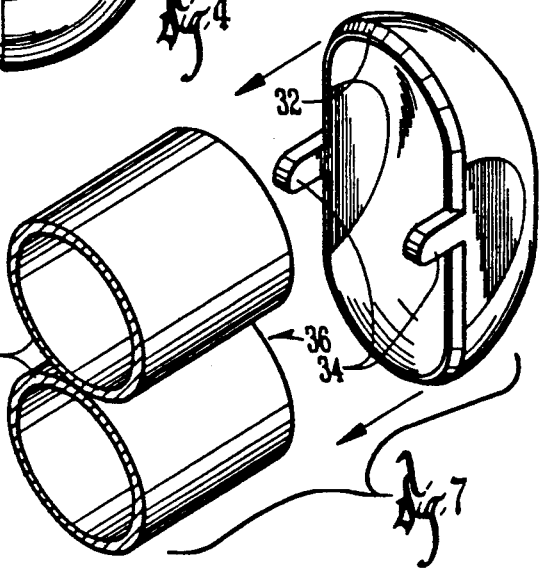
FIG. 7 is an exploded perspective view similar to FIG. 5.

End cap 26 is welded to the ends of adjacent pipes 24 in the cooling coils of furnace 10. In assembling the pipes and end caps, the cap is positioned in alignment with the ends of pipe 24 and tabs 34 are bent inwardly so as to fill the valley or crevice 36 therebetween. As shown in FIG. 6, the upper tab has been bent inwardly and the lower tab has not yet been bent. End cap 26 is then welded to the ends of pipes 24. Tab 34 provides for a stronger weld, since it minimizes the amount of weld compound which must be utilized in the area of valley 36 between the pipes 24. Furthermore, the additional surface area provided by tabs 34 and the beveled portion of rim 32 provide for a stronger weld.

End cap 26 is preferably made of 516 grade 70 plate steel, or other high quality commercial grade steel. Cap 26 is forged, either hot or cold, or may be formed by casting.

In operation, water or another liquid coolant is forced through coils 22 so as to cool furnace 10. As the water or coolant passes through one of pipes 24, its direction is reversed 180 degrees by end cap 26 so as to flow through the adjacent pipe 24. The curvature of end cap 26 allows for smooth fluid flow at rates of approximately 7–9 feet per second. This construction of end cap 26 minimizes any changes in pressure as the coolant changes direction, inhibits the formation of bubbles or vapor, minimizes turbulent flow, and accordingly enhances the thermal conductivity of the cooling coils 22.

From the foregoing, it can be seen that the present invention accomplishes at least all of the stated objectives.

What is claimed is:

1. In an electric arc furnace having a cooling system with a plurality of pipes through which a liquid coolant flows, an improved end cap for closing the open ends of adjacent pipes, the end cap comprising:

opposite side walls;

a curved end portion interconnecting the side walls;

a perimeter edge defined by the side walls and end portion; and a pair of tabs extending from the perimeter edge adjacent each side wall so as to extend along opposite sides of the pipes and partially fill a crevice between the adjacent pipes.

2. The end cap of claim 1 wherein the side walls are parallel to one another.

3. The end cap of claim 1 wherein the tabs are parallel to one another.

4. The end cap of claim 1 wherein the tabs are bent inwardly toward one another.

5. The end cap of claim 1 wherein the end portion is semicircular in cross section.

6. The end cap of claim 1 wherein the end portion has a constant radius.

7. The end cap of claim 1 wherein the radius of the end portion equals the diameter of the pipe.

8. The end cap of claim 1 wherein the tabs extend perpendicularly from the perimeter edge.

9. The end cap of claim 1 wherein the perimeter edge is beveled.

10. The end cap of claim 1 wherein the perimeter edge is beveled across a portion of its thickness.

11. An end cap for providing fluid communication between a pair of adjacent pipes, the end cap being weldable to the ends of the pipes and comprising:

a semi-circular body having opposite sides and a perimeter edge; and a pair of tabs extending from perimeter edge adjacent the sides of the body so as to extend along opposite sides of the pipes and partially cover the pipes when the perimeter edge is abutted against the ends of the pipe.

12. The end cap of claim 11 wherein the sides of the body are parallel to one another.

13. The end cap of claim 11 wherein the radius of the body equals the diameter of the pipe.

14. The end cap of claim 11 wherein the perimeter edge defines a plane, and each tab is elongated and has a longitudinal axis perpendicular to the plane of the perimeter edge.

15. The end cap of claim 11 wherein the perimeter edge includes a beveled portion.

16. A cooling system for an electric arc furnace, comprising:

a plurality of adjacent pipes with a crevice area therebetween, each pipe having open ends;

a plurality of curved end caps having opposite sides and a perimeter edge, the end cap being connected to and extending in covering relation over the ends of adjacent pipes so as to define a serpentine path through the pipes;

a pair of tabs extending from the perimeter edge adjacent each side of the end cap so as to extend along opposite sides of the pipes and partially fill the crevice area between pipes; and a sealant along the perimeter edge of the end cap and around the tabs so as to sealingly connect the ends of the pipes and the end cap.

17. The cooling system of claim 16 wherein the sealant is formed by welding.

18. The cooling system of claim 17 wherein the tabs are bent inwardly toward one another.

19. The cooling system of claim 16 wherein the end cap has a radius equal to the diameter of the pipe.

20. The cooling system of claim 16 wherein the end cap is semi-circular in cross section.

* * * * *